United States Patent [19]

Hill

[11] 3,972,768

[45] Aug. 3, 1976

[54] CARPET SEAMING TAPE, ELECTRIC IRON THEREFOR

[75] Inventor: Harvey J. Hill, Monterey Park, Calif.

[73] Assignee: Roberts Consolidated Industries, Inc., City of Industry, Calif.

[22] Filed: July 8, 1974

[21] Appl. No.: 486,422

[52] U.S. Cl. ..... 156/545; 38/88; 38/93; 38/94; 156/201; 156/220; 156/505; 156/579; 219/245; 223/34; 223/36; 428/101; 428/122; 428/126; 428/130; 428/195; 428/200; 428/236; 428/247; 428/264; 428/265; 428/268; 428/346; 428/354

[51] Int. Cl.[2] ..... B32B 3/02; B32B 3/04; C09D 7/04; D06F 75/38

[58] Field of Search ..... 38/88, 93, 94; 156/502, 156/505, 545, 579, 581, 583; 161/88, 89, 92, 93, 99, 100, 104, 108, 146, 167, 50, 51; 219/228, 243, 245; 223/34, 36; 428/101, 122, 126, 130, 195

[56] References Cited

UNITED STATES PATENTS

| | | | |
|---|---|---|---|
| 128,722 | 7/1872 | Gird | 223/34 |
| 778,083 | 12/1904 | Strauss | 38/94 |
| 864,459 | 8/1907 | Duncan | 38/94 |
| 891,730 | 6/1908 | Pitcher | 38/94 |
| 1,001,443 | 8/1911 | Graf | 38/94 |
| 1,320,692 | 11/1919 | Hulse | 161/167 |
| 1,771,328 | 7/1930 | Gabel | 223/36 |
| 2,647,850 | 8/1953 | Reinhard | 161/167 |
| 2,852,423 | 9/1958 | Bassett | 161/104 |
| 3,035,956 | 5/1962 | Gonda et al. | 161/167 |
| 3,263,898 | 8/1966 | Blish | 161/104 |
| 3,485,704 | 12/1969 | Clymin | 161/89 |
| 3,518,145 | 6/1970 | Christensen | 428/195 |
| 3,523,176 | 8/1970 | Hill | 38/88 |
| 3,582,436 | 6/1971 | Bucher | 156/502 |
| 3,619,333 | 11/1971 | Mender | 156/505 |
| 3,651,305 | 3/1972 | Shimota | 219/243 |
| 3,755,058 | 8/1973 | Winkler | 161/93 |

*Primary Examiner*—J.C. Cannon

*Attorney, Agent, or Firm*—Harris, Kern, Wallen & Tinsley

[57] ABSTRACT

A hot-melt carpet seaming tape having means for co-operating with a specially designed electric iron to maintain registery of the tape and iron while the heated iron is moved along and over the tape beneath the abutting edges of carpet segments to adhere the segments to the tape and together in a novel process for accomplishing the same.

10 Claims, 10 Drawing Figures

CARPET SEAMING TAPE, ELECTRIC IRON THEREFOR

BACKGROUND OF INVENTION

Conventional hot-melt carpet seaming tape for joining abutting edges of carpet has long been on the market. Illustrations of such tape are disclosed fully in the U.S. patents to Burgess, U.S. Pat. No. 3,400,038, issued Sept. 3, 1968, and Clymin, U.S. Pat. No. 3,485,704, issued Dec. 23, 1969.

Such conventional hot-melt seaming tape usually has a backing of paper with a layer or layers of heat sensitive adhesive adhered or otherwise secured to the paper. In conventional use in face seaming two segments of carpet are laid on a floor or other supporting surface with edges of the segments abutting with the joint line between the segments in approximate registry with the centerline of a length of such tape laid beneath the carpet. A hot electric iron is then passed along the tape between and under the abutting edges of the carpet and in contact with the adhesive of the tape to melt the same, the tacky adhesive sticking to the bottom or backing of the carpet segments to adhere the segments to the tape and indirectly to each other through the tape to provide an almost invisible seam between the carpet segments.

Electric irons for such carpet seaming are disclosed in the U.S. patents to Burgess, U.S. Pat. No. 3,400,245, issued Sept. 3, 1968, and Hill, U.S. Pat. No. 3,523,176. Such method of face-seaming carpet is disclosed in said patents as well as the U.S. patent to Burgess, U.S. Pat. No. 3,415,703, issued Dec. 10, 1968.

In such face seaming of carpet with such conventional seaming tapes and irons, it is very important to correctly align the tape with the joint between the carpet segments, to align the iron relative to the tape and joint, and to maintain them in such alignment during movement of the iron along the tape to insure that the adhesive on the tape is melted uniformly and is about equally applied to each carpet segment, to form the most effective joint between the segments. Difficulty is usually experienced in doing so because the tape tends to slide laterally on the floor or other supporting surface and the iron tends to slide laterally on the tape. The operation is complicated by the fact that the tape and most of the iron are covered by the carpet segments in face seaming, and proper alignment can be maintained only by parting the carpet segments frequently and visually correcting any misalignment, which is undesirably time consuming and does not assure correct alignment in subsequent movement of the iron. Most of such hot-melt carpet seaming tape sold commercially is provided with a visible center guide line to assist in such visual alignment, but is of little assistance to the mechanic in maintaining alignment during movement of the iron along the tape.

The U.S. Pat. No. 3,582,436, to Bucher, issued June 1, 1971, describes some of the difficulties involved in maintaining alignment of hot-melt seaming tape and the joint between abutting carpet edges to be seamed, and describes a specially designed electric iron for allegedly accomplishing such alignment. My experiments, however, have indicated that the results claimed by the Bucher patent for its electric iron will not, at least with any assurance or regularity, be attained in normal use to maintain such alignment.

THE INVENTION — GENERALLY

A primary object of the present invention is to provide a novel hot-melt carpet seaming tape which can be used with a novel electric iron in face-seaming carpet segments to insure alignment of the iron with the tape and alignment of the tape with the joint between the segments. By so assuring such alignments, a narrower and less expensive hot-melt seaming tape can be used than is currently available on the market, and a better and more permanent seam can be provided between carpet segments than is uniformly possible with presently available tapes, irons, and methods of using them. I accomplish this by providing a hot-melt seaming tape having a layer of hot-melt adhesive on a backing strip of paper or other flexible material, in which the outer edges of the adhesive layer are not adhered or fastened to the backing strip so that such edges may be spaced and used as guides for an electric iron moved therealong, and by providing an electric iron having means for cooperating with said outer edges of such an adhesive layer for maintaining the tape and iron in alignment as the iron is moved along the tape.

A further object of the invention is to provide such an electric iron which also can be used for either face-seaming or back-seaming carpet with all conventional hot-melt tapes whether of the type disclosed in said Burgess patents or the type disclosed in said Clymin patent.

Another object of the invention is to provide a novel process in which my tape and iron are employed for face-seaming carpet segments. I prefer to accomplish this by utilizing the edges of the hot-melt adhesive on such seaming tape, in cooperation with grooves in such an electric iron, to maintain correct alignment of the iron and tape as the iron is moved along the tape.

Still another object of the invention is to provide such a tape which can be used with conventional irons for either face-seaming or back-seaming carpet segments, by conventional methods and processes.

Other objects and advantages of the invention will appear from the detailed description hereinafter.

DRAWINGS

DETAILED DESCRIPTION OF INVENTION

Figure 1:
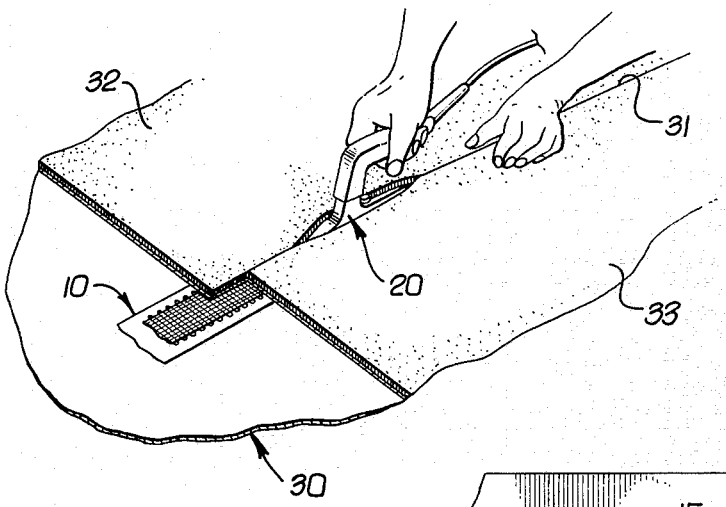
FIG. 1 is a perspective view of the hot-melt seaming tape and hot-melt iron of the invention.

Face-seaming of carpet is illustrated in FIG. 1 in which a hot-melt seaming tape 10 is laid upon a floor 30, or other supporting surface such as carpet padding, with its centerline substantially aligned with a joint 31 between abutting carpet segments 32 and 33, and a heated electric iron 20 is moved along the tape between the tape and the carpet segments and in the joint 31.

Figure 2:
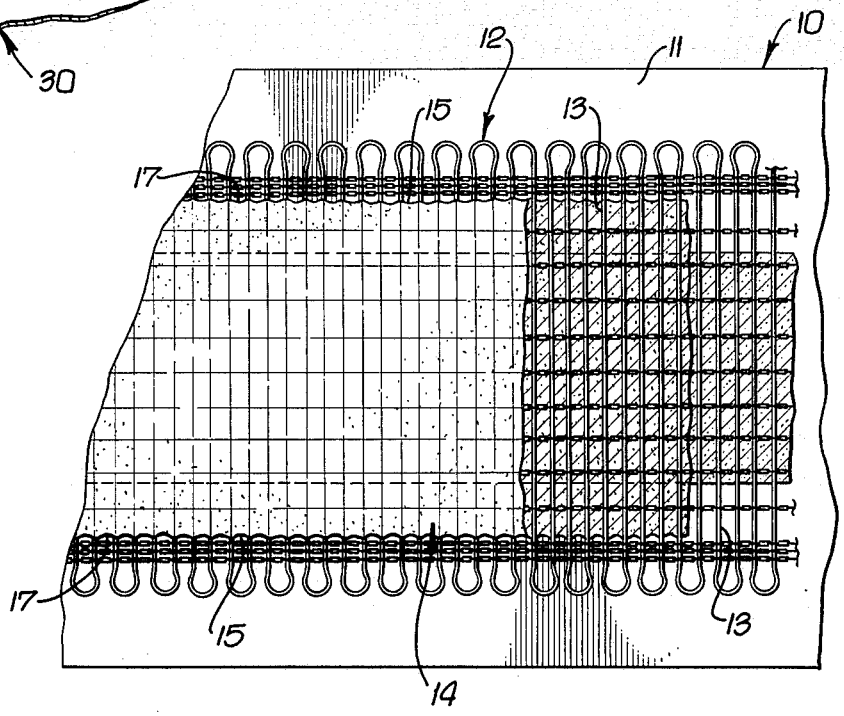
FIG. 2 is a plan view of the hot-melt tape of the invention.
Figure 3:
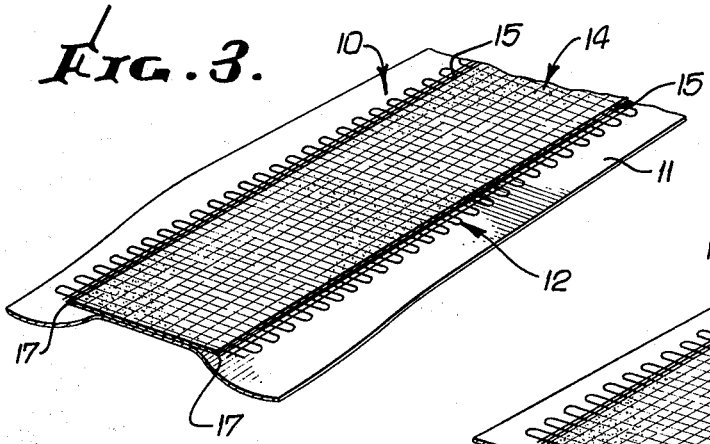
FIG. 3 is a perspective view of FIG. 2.

Referring to FIGS. 2 and 3 of the drawings, the hot-melt carpet seaming tape 10, includes a backing or barrier layer 11, formed of crepe paper or the equivalent, a web layer 12, formed of natural, synthetic, or glass fibers or the like, having open interstices 13 therein, and an adhesive layer 14 having outer longitudinal edges 15. The adhesive layer 14 is formed of a thermoplastic adhesive material which will melt when heat is applied thereto to render it tacky so that it still stick to and form a bond with material pressed thereon, such as any of the adhesives described in said patents identified above. The adhesive layer as shown in FIGS. 2 and 3, is continuous laterally, and this is the preferred construction, but it may be formed by laterally spaced longitudinal beads of adhesive as disclosed in said Clymin patent, although the latter is not the preferred embodiment as a laterally continuous layer provides a layer more resistant to lateral bending, which is desirable. The adhesive layer 14 is longitudinally flexible but provides resistance to transverse compression.

Figure 4:
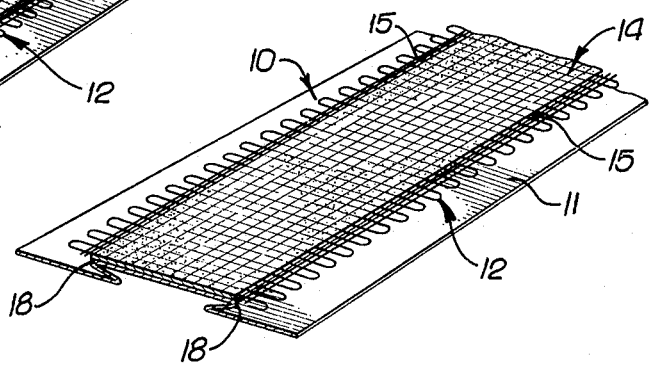
FIG. 4 is a view similar to FIG. 3 of an alternative form of the tape of the invention.
Figure 5:
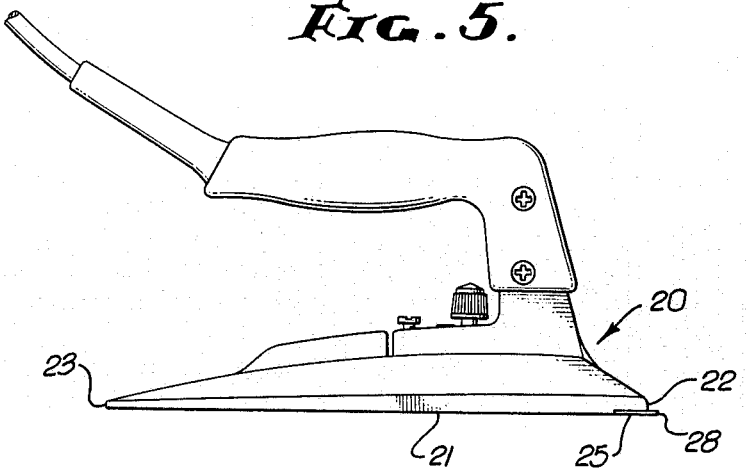
FIG. 5 is a side elevational view of the electric iron of the invention.
Figure 7:
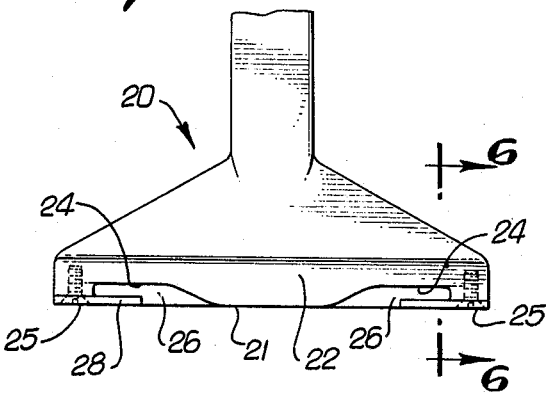
FIG. 7 is a front view of FIG. 5.
Figure 6:
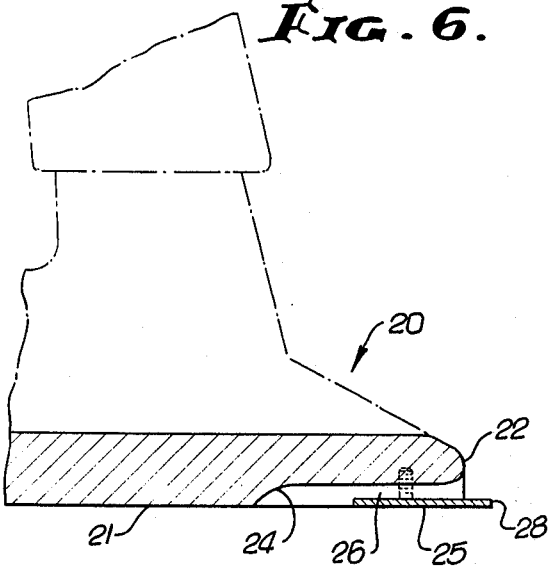
FIG. 6 is an enlarged, detailed sectional view taken on line 6—6 of FIG. 7.
Figure 8:
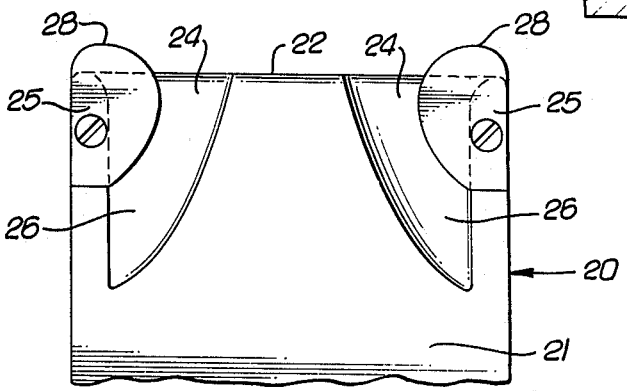
FIG. 8 is a partial bottom view of FIG. 5.

The adhesive layer 14 is secured to the barrier layer 11, preferably being bonded thereto by partially melting the adhesive layer or secured thereto by staples or otherwise. If the adhesive layer 14 is partially melted it will pass through interstices 13 in the web layer 12 to come in contact with and bond to the barrier layer 11. The web layer 12 may be a separate layer as shown, may be imbedded in the adhesive layer 14, or may be omitted entirely if desired. Although the web layer 12 is shown in FIGS. 2, 3 and 4 as extending beyond the longitudinal edges 15 of the adhesive layer 14 it may register therewith or even be narrower than the adhesive layer.

In the preferred form of the invention, shown in FIGS. 2 and 3, the outer edges 15 of the adhesive layer are separated from and left free of the barrier layer 11 to provide longitudinal guide lips 17, which are an important part of the invention relating to the seaming tape 10. Alternatively, each of the edges of the barrier layer 11 may be folded back under itself to provide a guide lip 18, as shown in FIG. 4, to serve the same purpose as the guide lips 17, as described in detail hereinafter.

The electric iron 20, illustrated in FIGS. 5, 6, 7, 8, 9, and 10 includes a generally rectangular and flat sole plate 21, having a width similar to or somewhat greater than the width of the adhesive layer 14 of the seaming tape 10. Apart from such sole plate 21 and its details, the iron 20 is of conventional form as described in said patent to Hill and is heated electrically as described therein. The iron 20 has a leading edge 22 and a trailing edge 23. At each side of the sole plate 21 adjacent its leading edge 22 is an indentation 24 in which is seated a flange 25, secured to the sole plate by suitable screws or otherwise. Each flange 25 is spaced from the wall of its indentation 24 to provide a guide groove 26, for a purpose to be described hereinafter. The flanges 25 may be separate pieces as illustrated, or, alternatively, may be integral with the sole plate 21. The lower surfaces of the flanges 25 are preferably in the same plane as the bottom of the sole plate 21, and also, preferably, the forward end of each flange extends forwardly of the leading edge 21 of the sole plate to form a nose 28 which assists accomplishing the purposes of the invention as described hereinafter. Each of the guide grooves 26 preferably does not thicken from front to rear.

Figure 9:
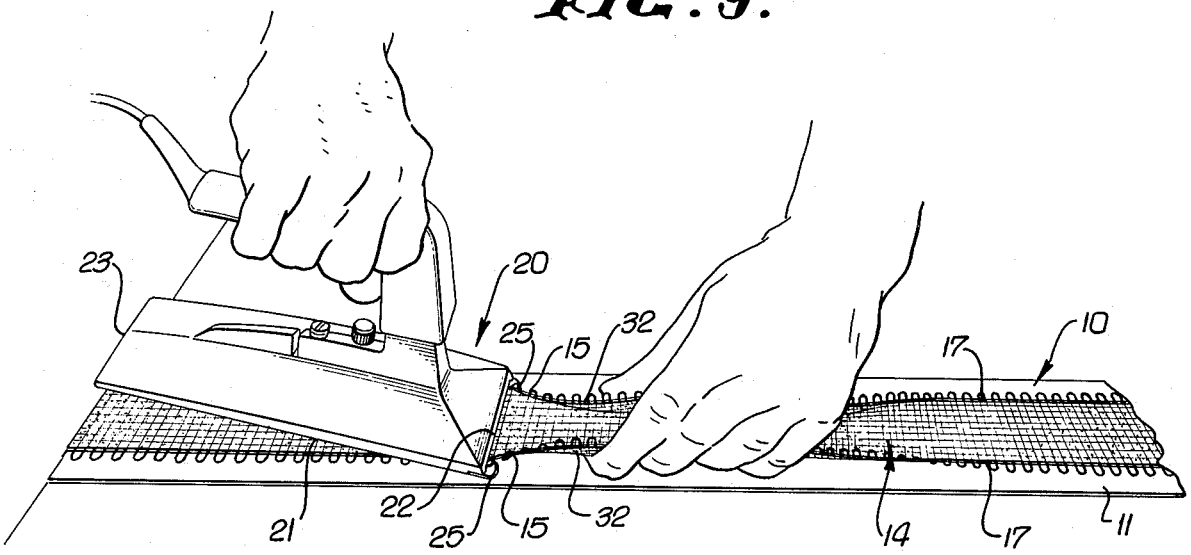
FIG. 9 is a perspective view illustrating the manner of attaching the iron and tape together.
Figure 10:
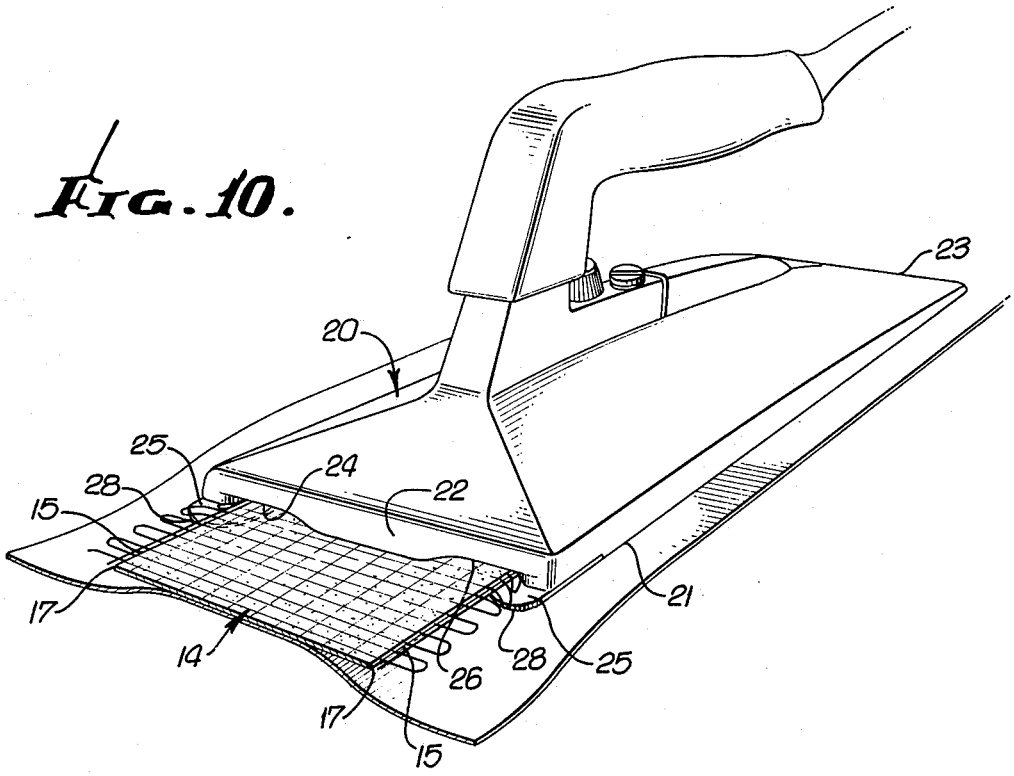
FIG. 10 is a perspective view illustrating the cooperation of the iron and tape of the invention after they have been attached together.

In face-seaming carpet, as illustrated in FIG. 1, the iron 20 is attached to the tape 10, preferably as illustrated in FIG. 9 in which the adhesive layer 14 of the tape is manually bowed laterally, as at 32 and the longitudinal edges 15 are slipped into the guide grooves 26 of the iron and then released so that the natural resiliency of the adhesive layer 14 flattens out the tape so that the adhesive layer extends into and substantially to the outer ends of the guide grooves and is retained therein as illustrated in FIG. 10. The fibers constituting the web layer 12 are so thin and flexible that those extending laterally beyond the edges 15 of the adhesive layer 14 merely bend upon themselves during connection of the tape 10 and iron 20 and do not interfere either with such connection or subsequent relative movement between the iron and the tape. The carpet segments 32 and 33 are then placed around the iron 20 as illustrated in FIG. 1, the iron is electrically heated to a temperature sufficient to melt the adhesive layer 14, and the iron is moved longitudinally along the tape 10 to melt the adhesive layer 14, and as the iron is so moved the abutting edges of the carpet segments 32 and 33 are manually pressed down upon the melted adhesive layer, as shown in FIG. 1, to bond thereto for a practically invisible seam between the segments. Instead of attaching the tape 10 and iron 20 as shown in FIG. 9, an end of the adhesive layer 14 may be simply threaded into the guide grooves 26. In either method of attachment, the noses 28 of the flanges 25 assist in introducing the adhesive layer 14 of the tape 10 into the guide grooves 26. It is to be understood that the portion of the adhesive layer 14 passing through the guide grooves 26 does not melt until after it has been in contact with the hot surfaces of the iron for a period of time. While the iron is moving, melting will therefore occur sometime after the leading edges of the slots have guided the tape into centerline alignment with the iron. The portion of the adhesive layer in the guide grooves remains laterally stiff enough to insure such guiding and alignment as the iron passes along the tape and does not retard the progress of the iron. It is also to be noted that the guiding of the tape 10 by iron 20 is by the edges 15 of the adhesive layer 14, and not by the outer longitudinal edges of the barrier layer 11 which usually is made of paper or other readily flexible material which would merely curl or bend instead of forcing the tape to its centered position relative to the iron.

During movement of the iron 20 along the tape 10 in such face-seaming, the guide grooves 26 insure that the tape remains in center alignment with the iron as any slight change of direction of the iron similarly moves the tape laterally. Since the iron 10 is moved along the joint 31 between the carpet segments 32 and 33 automatic alignment is maintained of the iron and tape with such joint without any necessity of periodically visually checking such alignment during the seaming operation, resulting in a better seam between the carpet segments since substantially equal amounts of adhesive are applied to both segments, and resulting in a reduction of the labor time normally involved in face-seaming carpet. Such advantages also permit the use of a narrower adhesive layer 14 on the tape 10 than is normally used with conventional hot-melt seaming tapes on the market, with a permissible corresponding narrowing of the barrier layer 11 and web layer 12, resulting in a saving of materials and a reduction in the cost of my seaming tape. At the end of forming a seam, or at any intermediate point, the iron 20 readily can be separated from the tape 10 merely by lifting it off the tape, either before or after the adhesive in the grooves 26 is melted.

It is also to be noted that although the tape 10 is specifically designed for use with my iron 20 in the above described method, the tape 10 can also be used with conventional irons as described in the above patents in the conventional methods of face-seaming as described in such patents. Furthermore, although my iron 20 is specially designed for use with my tape 10, it can also be used with conventional hot-melt seaming tapes in the conventional manner since the bottoms of the flanges 25 are in the same plane as the major portion of the sole plate 21. These are further separate advantages of my tape 10 and iron 20.

I calim as my invention:

1. In an electric iron for heating a hot-melt carpet seaming tape having longitudinal guide edges along each side thereof, the combination of:

an elongated, generally rectangular sole plate having leading and trailing ends;

and parallel plate edges, said plate having a flange-defined guide groove therein adjacent to each of said plate edges inwardly of said edges at the leading end of said plate and generally parallel to the bottom surface of said plate, each of said guide grooves comprising a horizontally inwardly facing channel and each being adapted to receive one of the guide edges of such a seaming tape so as to center the tape relative to the iron and maintain the tape centered relative to the iron as the iron is moved longitudinally along the tape; and electrical heating means associated with said sole plate for heating it, to melt an adhesive on such tape.

2. An iron as defined in claim 1, in which each of said guide grooves has a length substantially less than the length of said plate.

3. An iron as defined in claim 2, in which each of said guide grooves is formed in part by a flat guide lip which extends beyond the leading edge of said sole plate to assist in guiding such a seaming tape into said grooves.

4. An iron as defined in claim 2, in which each of said guide grooves is formed by an indentation in the bottom of said sole plate and a flat guide lip secured to said plate and parallel to the bottom of said plate.

5. An iron as defined in claim 4, in which the bottom of said guide lip is in the same plane as the bottom of said sole plate.

6. In a carpet seaming tape, the combination of:

a barrier layer of thin and limp continuous tape having substantially parallel outer edges;

an adhesive layer of hot-melt adhesive on and secured to said barrier layer, said adhesive layer having parallel outer edges spaced inwardly from the outer edges of said barrier layer and generally parallel thereto, each of said outer edge portions of said adhesive layer overlying the barrier layer but being free of securement thereto to form a guide strip portion along each outer edge of said adhesive layer, said adhesive layer being longitudinally flexible but providing resistance to transverse compression.

7. A carpet seaming tape as defined in claim 6, in which the adhesive layer is continuous laterally.

8. A carpet seaming tape as defined in claim 6, in which the adhesive layer is reinforced by a flexible web formed of discrete elements spaced from each other to provide interstices therebetween.

9. A carpet seaming tape as defined in claim 8, in which outer longitudinal edges of the web extend beyond said outer edges of said adhesive layer and are generally parallel thereto but are spaced inwardly from said outer edges of said barrier layer.

10. In a carpet seaming tape, the combination of:

a barrier layer of thin and limp continuous tape having substantially parallel outer edges;

an adhesive layer of hot-melt adhesive on and secured to said barrier layer, said adhesive layer having parallel outer edges spaced inwardly from the outer edges of said barrier layer and generally parallel thereto, each of the outer edge portions of said barrier layer adjacent to an outer edge of said adhesive layer is folded back upon itself a first time under the adjacent outer edge of said adhesive layer to form a folded back portion and is folded a second time in the reverse direction to form guide strips along each outer edge of said adhesive layer, said adhesive layer being longitudinally flexible but providing resistance to transverse compression.

* * * * *